US009437092B2

(12) United States Patent
Warmack et al.

(10) Patent No.: US 9,437,092 B2
(45) **Date of Patent: *Sep. 6, 2016**

(54) SMOKE DETECTION

(71) Applicant: UT-Battelle, LLC, Oak Ridge, TN (US)

(72) Inventors: Robert J. Bruce Warmack, Oak Ridge, TN (US); Dennis A. Wolf, Oak Ridge, TN (US); Steven Shane Frank, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/859,631

(22) Filed: Sep. 21, 2015

(65) Prior Publication Data

US 2016/0012698 A1 Jan. 14, 2016

Related U.S. Application Data

(63) Continuation of application No. 14/162,547, filed on Jan. 23, 2014, now Pat. No. 9,171,453.

(51) Int. Cl.

| | |
|---|---|
| ***G08B 17/10*** | (2006.01) |
| ***G08B 29/20*** | (2006.01) |
| ***G08B 3/10*** | (2006.01) |
| ***G08B 17/117*** | (2006.01) |
| ***G08B 17/00*** | (2006.01) |
| ***G08B 29/18*** | (2006.01) |

(52) U.S. Cl.

CPC ..... *G08B 17/10* (2013.01); *G08B 3/10* (2013.01); *G08B 17/00* (2013.01); *G08B 17/117* (2013.01); *G08B 29/188* (2013.01); *G08B 29/20* (2013.01)

(58) Field of Classification Search

CPC ..... G08B 17/10; G08B 17/117; G08B 3/10; G08B 29/20

USPC ..... 340/514, 577, 584, 628, 632; 700/299

See application file for complete search history.

(56) References Cited

U.S. PATENT DOCUMENTS

| | | | |
|---|---|---|---|
| 3,541,539 | A | 11/1970 | Trumble |
| 5,724,255 | A | 3/1998 | Smith et al. |
| 5,764,142 | A | 6/1998 | Anderson et al. |
| 5,831,524 | A | 11/1998 | Tice et al. |
| 6,400,265 | B1 | 6/2002 | Saylor et al. |

(Continued)

OTHER PUBLICATIONS

Cestari et al., "Advanced fire detection algorithms using data from the home smoke detector project," *Fire Safety Journal*, 40:1-28 (2005).

(Continued)

*Primary Examiner* — Fekadeselassie Girma
*Assistant Examiner* — Stephen Burgdorf
(74) *Attorney, Agent, or Firm* — Klarquist Sparkman, LLP

(57) ABSTRACT

Various apparatus and methods for smoke detection are disclosed. In one embodiment, a method of training a classifier for a smoke detector comprises inputting sensor data from a plurality of tests into a processor. The sensor data is processed to generate derived signal data corresponding to the test data for respective tests. The derived signal data is assigned into categories comprising at least one fire group and at least one non-fire group. Linear discriminant analysis (LDA) training is performed by the processor. The derived signal data and the assigned categories for the derived signal data are inputs to the LDA training. The output of the LDA training is stored in a computer readable medium, such as in a smoke detector that uses LDA to determine, based on the training, whether present conditions indicate the existence of a fire.

20 Claims, 12 Drawing Sheets

(56) References Cited

U.S. PATENT DOCUMENTS

| | | | | |
|---|---|---|---|---|
| 8,064,722 | B1 * | 11/2011 | Rose-Pehrsson | G06K 9/527 327/1 |
| 2004/0080409 | A1 | 4/2004 | Reghetti et al. | |
| 2009/0261980 | A1 * | 10/2009 | Ankara | G08B 29/22 340/584 |
| 2010/0127849 | A1 | 5/2010 | Barrieau et al. | |
| 2011/0018726 | A1 | 1/2011 | Gonzales | |

OTHER PUBLICATIONS

Chen et al., "Development of a Fire Detection System Using FT-IR Spectroscopy and Artificial Neural Networks," *Fire Safety Science*, Sixth International Symposium, International Association for Fire Safety Science (IAFSS), 13 pages (Jul. 1999).

Gottuk et al., "Advanced fire detection using multi-signature alarm algorithms," *Fire Safety Journal*, 37:381-394 (2002).

Rose-Pehrsson et al., "Multi-criteria fire detection systems using a probabilistic neural network," *Sensors and Actuators B*, 69:325-335 (2000).

Thomas et al., "Awakening of Sleeping People: A Decade of Research." *Fire Technology* 46(3): 743-61 (2010).

Warmack et al., "Discriminant Analysis for Home Fire Alarms," PowerPoint Presentation for SUPDET 2012, 19 pages (Mar. 2012).

Warmack et al., "Discriminant Analysis for Home Fire Alarms," Abstract for Presentation for SUPDET 2012, Phoenix, Arizona, 2 pages (Mar. 2012).

Warmack et al., "Home Smoke Alarms, A Technology Roadmap," http://www.ornl.gov/sci/ees/mssed/ TechRoadmapResSmokeAlarms.pdf, 32 pages (Mar. 2012).

* cited by examiner

CO

| Raw data ($V_i$) | | | Baselines ($B_i$) | | | LD Signals ($S_i$) | | | Assigned Group |
|---|---|---|---|---|---|---|---|---|---|
| Time (s) | T | Ion | n=32 | n=64 | n=2048 | ΔT | ΔionS | Δion | |
| | | | T_base | IonS_base | Ion_base | | | | |
| 0 | 593 | 41 | 593.0 | 41.0 | 41.0 | 0.0 | 0.0 | 0.0 | Normal |
| 10 | 593 | 41 | 593.0 | 41.0 | 41.0 | 0.0 | 0.0 | 0.0 | Normal |
| 20 | 598 | 41 | 593.2 | 41.0 | 41.0 | 4.8 | 0.0 | 0.0 | Normal |
| 30 | 598 | 41 | 593.3 | 41.0 | 41.0 | 4.7 | 0.0 | 0.0 | Normal |
| 40 | 596 | 20 | 593.4 | 40.7 | 41.0 | 2.6 | -20.7 | -21.0 | Normal |
| 50 | 596 | 20 | 593.5 | 40.3 | 41.0 | 2.5 | -20.3 | -21.0 | Normal |
| 60 | 598 | 20 | 593.6 | 40.0 | 41.0 | 4.4 | -20.0 | -21.0 | Normal |
| 70 | 598 | 36 | 593.8 | 40.0 | 41.0 | 4.2 | -4.0 | -5.0 | Normal |
| 80 | 598 | 20 | 593.9 | 39.7 | 41.0 | 4.1 | -19.7 | -21.0 | Normal |
| 90 | 598 | 36 | 594.0 | 39.6 | 41.0 | 4.0 | -3.6 | -5.0 | Normal |
| 100 | 596 | 31 | 594.1 | 39.5 | 40.9 | 1.9 | -8.5 | -9.9 | Normal |
| 110 | 616 | 72 | 594.8 | 40.0 | 41.0 | 21.2 | 32.0 | 31.0 | (excluded) |
| 120 | 624 | 143 | 595.7 | 41.6 | 41.0 | 28.3 | 101.4 | 102.0 | Flaming |
| 130 | 621 | 174 | 596.5 | 43.7 | 41.1 | 24.5 | 130.3 | 132.9 | Flaming |
| 140 | 621 | 225 | 597.2 | 46.5 | 41.2 | 23.8 | 178.5 | 183.8 | Flaming |
| 150 | 644 | 261 | 598.7 | 49.8 | 41.3 | 45.3 | 211.2 | 219.7 | Flaming |
| 160 | 657 | 307 | 600.5 | 53.9 | 41.4 | 56.5 | 253.1 | 265.6 | Flaming |
| 170 | 655 | 307 | 602.2 | 57.8 | 41.5 | 52.8 | 249.2 | 265.5 | Flaming |
| 180 | 673 | 307 | 604.4 | 61.7 | 41.7 | 68.6 | 245.3 | 265.3 | Flaming |
| 190 | 673 | 322 | 606.6 | 65.8 | 41.8 | 66.4 | 256.2 | 280.2 | Flaming |
| 200 | 685 | 368 | 609.0 | 70.5 | 42.0 | 76.0 | 297.5 | 326.0 | Flaming |
| 210 | 678 | 425 | 611.2 | 76.0 | 42.1 | 66.8 | 349.0 | 382.9 | Flaming |
| 220 | 685 | 471 | 613.5 | 82.2 | 42.4 | 71.5 | 388.8 | 428.6 | (excluded) |
| ⋮ | ⋮ | ⋮ | ⋮ | ⋮ | ⋮ | ⋮ | ⋮ | ⋮ | |

FIG. 8

| Raw data ($V_i$) | | | Preprocessing and Baselines ($B_i$) | | | | | | LD Signals ($S_i$) | | | LD_Coords | | Distance^2 to centroids | | | Alarm |
|---|---|---|---|---|---|---|---|---|---|---|---|---|---|---|---|---|---|
| Time (s) | T | Ion | T_b*32 | T_base | I_5*64 | IonS_base | I_b*2048 | Ion_base | ΔT | ΔIonS | ΔIon | LD1 | LD2 | Normal | Flaming | Smoldering | |
| 0 | 593 | 41 | 18976 | 593 | 2624 | 41 | 83968 | 41 | -14 | -76 | -96 | -4 | -4 | 1 | 137 | 50 | None |
| 10 | 593 | 41 | 18976 | 593 | 2624 | 41 | 83968 | 41 | -14 | -76 | -96 | -4 | -4 | 1 | 137 | 50 | None |
| 20 | 598 | 41 | 18981 | 593 | 2624 | 41 | 83968 | 41 | -9 | -76 | -96 | -3 | -4 | 2 | 116 | 49 | None |
| 30 | 598 | 41 | 18986 | 593 | 2624 | 41 | 83968 | 41 | -9 | -76 | -96 | -3 | -4 | 2 | 116 | 49 | None |
| 40 | 596 | 20 | 18989 | 593 | 2603 | 40 | 83947 | 40 | -11 | -96 | -116 | -4 | -4 | 1 | 137 | 50 | None |
| 50 | 596 | 20 | 18992 | 593 | 2583 | 40 | 83927 | 40 | -11 | -96 | -116 | -4 | -4 | 1 | 137 | 50 | None |
| 60 | 598 | 20 | 18997 | 593 | 2563 | 40 | 83907 | 40 | -9 | -96 | -116 | -4 | -4 | 1 | 137 | 50 | None |
| 70 | 598 | 36 | 19002 | 593 | 2559 | 39 | 83903 | 40 | -9 | -79 | -100 | -3 | -4 | 2 | 116 | 49 | None |
| 80 | 598 | 20 | 19007 | 593 | 2540 | 39 | 83883 | 40 | -9 | -95 | -116 | -4 | -4 | 1 | 137 | 50 | None |
| 90 | 598 | 36 | 19012 | 594 | 2537 | 39 | 83879 | 40 | -10 | -79 | -100 | -4 | -4 | 1 | 137 | 50 | None |
| 100 | 596 | 31 | 19014 | 594 | 2529 | 39 | 83870 | 40 | -12 | -84 | -105 | -4 | -4 | 1 | 137 | 50 | None |
| 110 | 616 | 72 | 19036 | 594 | 2562 | 40 | 83902 | 40 | 8 | -44 | -64 | 1 | -3 | 25 | 45 | 52 | None |
| 120 | 624 | 143 | 19066 | 595 | 2665 | 41 | 84005 | 41 | 15 | 26 | 6 | 3 | -2 | 50 | 20 | 61 | Flaming |
| 130 | 621 | 174 | 19092 | 596 | 2798 | 43 | 84138 | 41 | 11 | 55 | 37 | 3 | -1 | 53 | 17 | 52 | Flaming |
| 140 | 621 | 225 | 19117 | 597 | 2980 | 46 | 84322 | 41 | 10 | 103 | 88 | 3 | 0 | 58 | 16 | 45 | Flaming |
| 150 | 644 | 261 | 19164 | 598 | 3195 | 49 | 84542 | 41 | 32 | 136 | 124 | 8 | 1 | 160 | 2 | 125 | Flaming |

FIG. 10

SMOKE DETECTION

CROSS REFERENCE TO RELATED APPLICATIONS

The present application is a continuation of co-pending U.S. patent application Ser. No. 14/162,547, filed Jan. 23, 2014, which is incorporated herein by reference in its entirety.

ACKNOWLEDGMENT OF GOVERNMENT SUPPORT

This invention was made with government support under Contract No. DE-AC05-00OR22725 awarded by the U.S. Department of Energy. The government has certain rights in the invention.

FIELD

The disclosure relates to smoke detection and methods to train a classifier of a smoke detector.

BACKGROUND

The introduction of smoke detectors and their widespread adoption has been tremendously successful in saving lives and improving the safety of building occupants. Smoke detectors are generally reliable and economical to employ but, there remain some shortfalls in operation. For example, nuisance or false alarms, which are triggered by non-fire related sources, account for the majority of smoke alarm activations. Many smoke detectors include an aerosol sensor that can be susceptible to false alarms caused by aerosols such as cooking fumes, dust, and fog. False alarms constitute a serious concern, as occupants sometimes disable the offending alarms, rendering them ineffective for warning occupants of genuine fires.

Further, construction methods and room furnishing materials have changed over time such that fire growth rates have increased and the time for safe egress has decreased. Arousing occupants in a timely manner can have a large impact upon fire safety, reducing the number of injuries and deaths.

SUMMARY

Accordingly, various embodiments are disclosed herein related to smoke detection and smoke detectors. In one embodiment, a method of training a classifier for a smoke detector comprises inputting sensor data from a plurality of tests into a processor. The sensor data is processed to generate derived signal data corresponding to the test data for respective tests. The derived signal data is assigned into categories desirably comprising at least one fire group and at least one non-fire group. Linear discriminant analysis (LDA) training is performed by the processor. The derived signal data and the assigned categories for the derived signal data are inputs to the LDA training. The LDA training desirably generates a centroid in linear discriminant coordinates for each of the categories of groups, a plurality of coefficients for transforming derived signal data into linear discriminant (LD) coordinates, and a mean of group means. The plurality of coefficients, the plurality of centroids, and the mean of group means are stored in a computer readable medium.

In an alternative embodiment, a method for detecting a hazardous condition comprises inputting sensor data from a plurality of tests into a processor. The term hazardous condition refers to a condition that is potentially harmful and that can be determined from the sensors being used (e.g., carbon monoxide levels in the case of a carbon monoxide sensor; fire in the case of temperature and aerosol sensors). The sensor data from the plurality of tests is processed using the processor to generate or provide derived signal data corresponding to the test data for respective tests. At least one group is assigned to the derived signal data for a respective test. The at least one group is selected from a plurality of groups including a normal group, a flaming fire group, and a non-flaming group. Linear discriminant analysis (LDA) training is performed using the derived signal data and the assigned at least one group for the respective tests as input to the LDA training. The output of the LDA training constitutes LDA training data and comprises a plurality of transformation coefficients for transforming derived signal data into linear discriminant (LD) coordinates, and desirably a mean of group means and a plurality of centroids in linear discriminant coordinates. The plurality of centroids desirably includes a different centroid for each of the plurality of groups. The plurality of transformation coefficients, the mean group of means, and the plurality of centroids is stored into a computer-readable memory which can be the memory of a smoke detector. One or more sensors coupled to the smoke detector is/are provided for sensing present environmental conditions and providing data corresponding to the sensed present environmental conditions. The data is desirably provided in a plurality of data channels. The data from the plurality of data channels is mapped into linear discriminant space using the plurality of stored transformation coefficients. The nearest centroid of the plurality of stored centroids to the data from the plurality of data channels mapped into linear discriminant space is determined. An alarm is signaled if the nearest centroid is in a group corresponding to a hazardous condition, such as a fire condition.

In an alternative embodiment, a smoke detector comprises a computer readable medium including a means to store linear discriminant analysis (LDA) training data. The LDA training data is generated by inputting sensor data from a plurality of tests. The sensor data is indicative of environmental conditions during the respective tests. The sensor data is processed to generate or provide derived signal data for the respective tests. The derived signal data for the respective tests is assigned or classified into categories or groups. Typically, the derived signal data for each of the respective tests is classified by designating or assigning at least one group to the derived signal data for the test. The tests can produce derived data over time periods or intervals and the derived data for different time intervals of a test can be assigned to a different group. The at least one group is selected from a plurality of groups and each group of the plurality of groups is associated with a hazardous condition or a non-hazardous condition. LDA training is performed using the derived signal data and the assigned at least one group for each test as input to the LDA training. The output of the LDA training is a plurality of transformation coefficients for transforming derived signal data into linear discriminant (LD) coordinates and desirably a mean of group means and a plurality of centroids in linear discriminant coordinates. The plurality of centroids desirably includes a different centroid for each group of the plurality of groups.

A smoke detector in accordance with this disclosure comprises at least one sensor configured to observe present environmental conditions. The at least one sensor desirably comprises at least one aerosol sensor. A processor is operatively connected to the at least one sensor. The processor is configured to process data from the at least one sensor to provide data in a plurality of data channels indicative of the present environmental conditions. The processor is configured to map the data from the plurality of data channels into linear discriminant space using the plurality of transformation coefficients stored in the computer readable medium. The processor is configured to classify the present environmental conditions as belonging to one group of the plurality of groups based on the linear discriminant mapping of the data from the plurality of data channels. The processor is configured to signal an alarm condition if the present environmental conditions are classified as belonging to a group associated with a hazardous condition. The smoke detector comprises an alarm operatively connected to the processor. The alarm generates an audible alert, a visual alert, or a combination thereof in response to the alarm signal.

The foregoing and other objects, features, and advantages of the invention will become more apparent from the following detailed description, which proceeds with reference to the accompanying figures.

BRIEF DESCRIPTION OF THE DRAWINGS

FIG. 8 illustrates example training data, processed baseline data, linear discriminant (LD) signals, and assigned groups.

FIG. 10 illustrates an example of the transformation of the experimental data in FIG. 8 from the time-domain to linear discriminant space.

DETAILED DESCRIPTION

Overview

Figure 1:
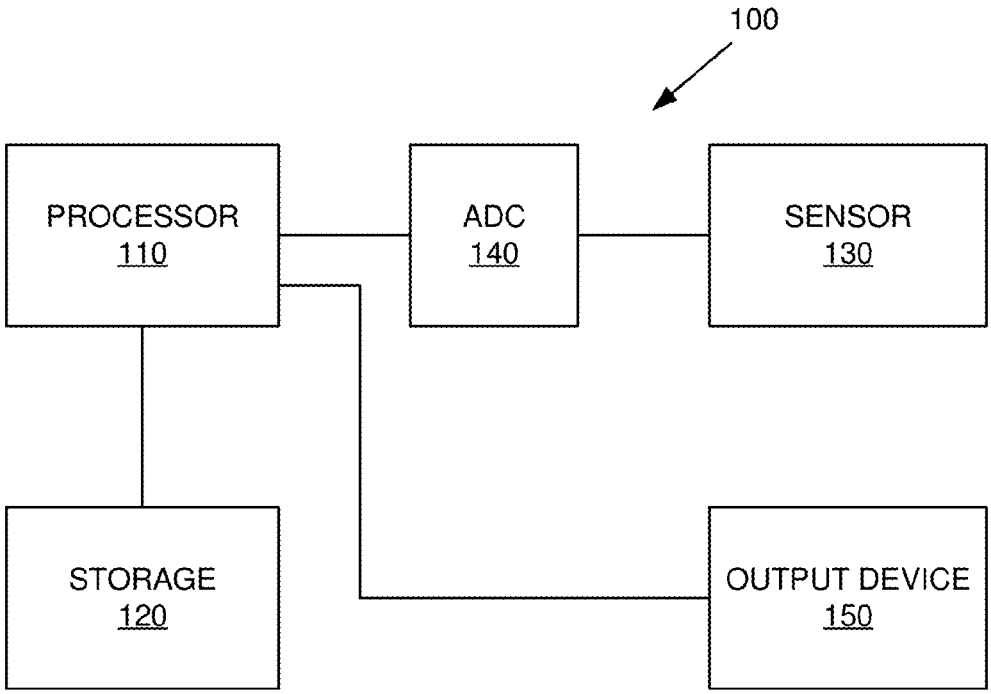
FIG. 1 illustrates a schematic of an example embodiment of a system for a smoke detector comprising one or more sensors.

This disclosure relates to smoke detectors. Throughout this specification the terms "smoke alarm" and "fire alarm" are used synonymously to mean "smoke detector." A smoke detector is a device that is used to detect one or more conditions related to combustion, smoldering, and/or the presence of toxic gas.

Many residential smoke alarms are based solely upon the detection of smoke aerosol particles emitted from fires. Aerosol sensors are of at least two types, ionization and photoelectric sensors. Ionization and photoelectric aerosol sensors are sensitive to various types of smoke aerosols but also, unfortunately, to other aerosols, including cooking fumes, dust, and fog. Some smoke alarms comprise a single type of aerosol sensor while other smoke alarms comprise both types of aerosol sensors. Combination ionization and photoelectric detectors provide sensitivity to aerosols from different types of fires. Thus, one sensor of a combination smoke detector can address a weakness of another type of sensor of the detector.

The concept of multiple sensors can be extended beyond multiple aerosol sensors. For example, a smoke detector can comprise additional sensors to detect other principal combustion products, such as heat, carbon monoxide (CO), and carbon dioxide ($CO_2$). For example, each of the sensors can provide a channel of data of the smoke detector so that the smoke detector has more information for recognizing conditions, adjusting alarm sensitivities, and deciding if an alarm condition exists.

One function of a fire alarm is to determine whether observed conditions indicate that an alarm is warranted. For most existing alarms with a single aerosol detector, classification is simply to alarm for aerosol concentrations beyond a fixed threshold. Unfortunately, nuisances can also sometimes trigger the alarm. Designing an alarm based upon whether any one of several channels exceeds a certain threshold can lead to excessive nuisance alarms if the thresholds are set too low, or insensitivity to fire conditions if the thresholds are set too high.

In accordance with this disclosure, Pattern recognition or statistical classification based on linear discriminant analysis is used to classify present environmental conditions as hazardous, warranting an alarm, based on groupings or determined from historical data of sensor responses to environmental conditions.

Discriminant analysis is an advanced statistical technique that allows data from multiple channels to be classified. Linear discriminant analysis (LDA), for example, involves a set of linear equations that can be readily evaluated on an inexpensive microcontroller of a smoke detector. The term microcontroller is synonymous with any type of electronic data processor. The linear coefficients for the LDA are determined beforehand using training data from fire scenarios. For example, data from prior tests is available from the Underwriter's Laboratory (UL) and the National Institute of Standards and Technology (NIST) and can be used for training. In one example, statistical techniques allow each sensor output and its rate of change to be included in the analysis. A smoke alarm employing one or multiple sensors and a suitably programmed microcontroller can provide faster response to real threats while rejecting conditions that would trigger false alarms in conventional smoke alarms.

Linear Discriminant Analysis

Linear discriminant analysis is a form of supervised pattern recognition that the inventors have recognized to be an advantageous approach for classification of conditions viewed as hazardous (e.g., fire indicating) based upon any number of sensor channels. A set of discrimination rules are constructed from training data and used to classify new observations into predefined groups. The basis for pattern recognition is desirably provided by actual field data of smoke, temperature, and combustion products for stimulating prescribed sets of sensors to be incorporated in a system.

Linear discriminant analysis (LDA) is one approach that classifies an observation according to its (multivariate) similarity or closeness to a group, category, or class of events. An LDA may include two distinct phases: a training phase and a classification phase. During the training phase, inputs to the LDA are one or more data variables or channels and data for classification into predefined groups. The data channels may include raw sensor data, derived sensor data, or a rate of change of sensor data. Outputs from the LDA may include transformation coefficients, a centroid corresponding to each predefined group, and a mean of group means. During the classification phase, the observed data variables are transformed by a linear transformation into new, uncorrelated variables, called discriminant coordinates, in such a way as to increase the differences among the predefined groups, as measured on these variables.

A goal of linear discriminant analysis (LDA) is to separate classes of events. For example, LDA can classify an observation at a point in time as belonging to a predefined group. LDA classifies each observation of all data channels using a linear transformation to obtain the discriminant coordinates, i.e., the observation's position in discriminant space. The closeness of the discriminant coordinates to each of the predefined classes or groups (e.g., "normal," "nuisance," "fire," "toxic," etc.) can then be calculated—even by an inexpensive microcontroller. The observation can be classified based on the nearest group.

In accordance with this disclosure, there is a hierarchy of the discriminant coordinates. The first discriminant coordinate, $LD_1$, accounts for the greatest separation among the groups; the second discriminant coordinate, $LD_2$, accounts for the next greatest separation, and so forth. The maximum number of discriminant coordinates that can be extracted is one fewer than the number of groups.

Plots of combinations of the various discriminant coordinates can be used to visualize group separations. Clear group separations seen in multi-dimensional plots will indicate success for those groups. As one example, two-dimensional plots can be used. Groups that appear to overlap in one plot (e.g., in the $LD_1$ vs. $LD_2$ plot), may appear separated in another two-dimensional view (e.g., $LD_2$ vs. $LD_3$). A discrimination rule can still be effective, even though there is no clear separation of groups in certain two-dimensional plots.

To illustrate a specific example, assume that the fire-detection system (e.g., smoke detector) consists of a microcontroller and three sensors: an ionization chamber, a thermistor, and a carbon monoxide (CO) sensor. The microcontroller can be configured, for example, based on training data from room-sized fires and nuisance sources for these three sensors. Specifically, the training data can be used to determine the linear transformation to discriminant coordinates $LD_i$, so that separation between one or more fire groups and the one or more nuisance groups is made. The data from the sensors may include their scalar values (preprocessed if desired, e.g., averaged and baselined) and their time derivatives for a total of six data channels. Suppose there are four groups of interest: "normal," "nuisance," "CO," and "fire," and there is training data from each group on all six channels. Since there are four groups, a maximum of three discriminant coordinates can be derived in this example. However, a good classification can be obtained by using only the first two coordinates. Let $V_i$ represent the six data channels and $a_i$ and $b_i$ represent the corresponding coefficients for the first and second linear discriminants derived from the training set. Suppose $(X_j, Y_j)$ represent the four group centroids calculated from the training data and expressed in linear discriminant coordinates. The coefficients $a_i$ and $b_i$ for transforming the data channels into discriminant coordinates and the centroids $(X_j, Y_j)$ of the four groups can be stored in a microcontroller.

During operation of the fire-detection system, the three sensors are sampled, the data are preprocessed, and the time derivatives are taken. In this example, the preprocessed data channels $V_i$ are then converted to discriminant coordinates $(LD_1, LD_2)$ by the linear transform:

$$\sum_i^n a_i V_i = LD_1$$

$$\sum_i^n b_i V_i = LD_2$$

The squared Euclidean distances to each of the centroids are then calculated in the example:

$$R_j^2=(X_j-LD_1)^2+(Y_j-LD_2)^2$$

The discriminant classification in this example is the nearest group to the data channels in discriminant space, e.g., the group associated with the smallest $R_j^2$. The discriminant classification can be sent to a monitoring station, used directly for alarm, or further checks and rules can be applied before sounding the alarm. Such an algorithm can be readily employed by inexpensive (<$1) microcontrollers.

Smoke Detector Systems

Turning to the figures, FIG. 1 illustrates a schematic of an example embodiment of a system 100 for a smoke detector comprising one or more sensors. System 100 includes a processor 110, storage 120, a sensor 130, an analog-to-digital converter (ADC) 140 (used to provide signal data if not available directly from the sensor), and an output device 150. In one embodiment, one or more components of the system 100 may be integrated into an application specific integrated circuit (ASIC) or programmable logic device.

In one embodiment, the processor 110 is a low-cost microcontroller, such as a MSP430, available from Texas Instruments (Texas, USA). In an alternative embodiment, the processor 110 may be a central processing unit (CPU) of a personal computer. The processor 110 is operatively connected to storage 120 and the processor 110 is configured to execute instructions that are stored in storage 120. The storage 120 is a computer readable medium and may include volatile and/or non-volatile storage such as read-only memory (ROM), random access memory (RAM), ferroelectric RAM (FRAM), FLASH memory, a hard disk drive, or other media suitable for storing computer-executable instructions and scratch-pad calculations of the processor 110. The storage 120 may be used for storing the outputs of LDA training, and the storage 120 may be populated with training data obtained from the method 700 as described below with reference to FIG. 7. The storage 120 may be used for storing instructions, which when executed by processor 110, are capable of carrying out methods of smoke detection. Thus, the processor 110 can be configured or programmed to perform LDA techniques and to analyze data from multiple channels of data to be classified as "fire," "nuisance," or "normal" conditions, such as described below with reference to FIG. 9. For systems that include a CO sensor, a fourth class can be added to indicate the presence of that toxic gas, such as according to UL-2034 specifications.

The processor 110 is operatively connected to and communicates with the output device 150. In one embodiment, the output device 150 can include a speaker and the processor 110 may be configured to modulate the speaker when a hazardous condition is detected. For example, the processor 110 can cause the speaker to emit one tone when a "fire" condition is detected and a different tone when a toxic gas condition is detected. In alternative embodiments, the output device 150 can include a sounder, a buzzer, a visual indicator, or combinations thereof.

The processor 110 is operatively connected to and communicates with the sensor 130. The processor 110 can receive data over a channel of data from the sensor 130, for example. In one embodiment, the output of the sensor 130 is an analog signal and the signal is converted to a digital signal via the ADC 140. The ADC 140 may be integrated within a microcontroller, such as the processor 110. In an alternative embodiment, the sensor 130 may output a digital signal which can be directly communicated to the processor 110. In yet another alternative embodiment, the processor 110 communicates with a plurality of sensors including the sensor 130. For example, the processor 110 can receive data over a channel of data from each of the sensors. In other words, the processor 110 can receive data from a plurality of data channels. In this manner, the processor 110 can receive multiple channels of data corresponding to multiple aspects of the environmental conditions.

The sensor 130 can be any type of sensor suitable for detecting one or more environmental conditions and outputting a signal corresponding to the one or more environmental conditions. Representative, but non-limiting, examples of sensors include aerosol (photoelectric and ionization), temperature, carbon monoxide, carbon dioxide, and Taguchi sensors. Factors for selecting which and how many sensors to use can include cost, power-consumption, reliability (lifetime and track-record with fire detection), resistance to false-alarms, and potential placement of the smoke detector.

Over the past four decades, aerosol sensors have proven to be very effective for fire detection. Photoelectric-type aerosol alarms are effective with larger-particle aerosols often associated with smoldering fires, while ionization-type aerosol alarms are sensitive to small-particle aerosols produced in flaming fires. Since these two sensor types tend to be complementary, it can be desirable to include both types of sensors to provide sensitivity for both types of fires. Photoelectric-type aerosol alarms can be desirable for smoke alarms that are to be placed primarily in bedrooms due to their sensitivity to smoldering fires. For example, a sleeping occupant in a bedroom may not be aware of a smoldering fire and so rapid detection can be desirable.

Temperature sensors are desirable to monitor the heat produced by a fire, especially with fast-growing fires. A thermistor is an inexpensive example of a suitable temperature sensor and can respond rapidly, uses low power, and is typically resistant to nuisance alarms.

Carbon monoxide is associated with nearly all fires, but it is generally not associated with typical nuisance sources that often cause false alarms. Manufacturers have developed practical electrochemical CO sensors for toxic-gas monitors and are beginning to incorporate them into home smoke alarms. These CO sensors respond discriminately, use very little power, and can last 7 years or more. These sensors can have sensitivity levels of less than 1 part per million (ppm) CO and rise times of roughly 20-30 seconds, which is consistent with early fire detection needs.

Carbon dioxide ($CO_2$) sensing is desirable. However, current $CO_2$ sensors consume more power than is desirable for a battery-operated residential smoke detector. Thus, current $CO_2$ sensors may be more desirable for wired systems that do not have a lengthy requirement for battery backup of the wired system. However, $CO_2$ sensors are a suitable option for smoke detectors of this disclosure, especially as their power requirements drop in the future.

Taguchi, or heated metal-oxide sensors, are also potentially suitable as sensors because of their sensitivity to combustion-related effluents. Such sensors can detect sub-ppm changes in CO, hydrocarbons, formaldehyde, HCN, HCl, acrolein, and other compounds. However, Taguchi sensors are also sensitive to humidity changes and to interferents like cigarette smoke and other household products, which limit effective levels of detection. Their properties can also change over time, and their responsiveness can diminish following exposure to silicones and hair grooming products, according to the manufacturer. Additionally, ordinary Taguchi sensors consume more power than is desirable for a battery-operated residential smoke detector. However, micro-fabricated versions might be operated at levels as low as 1 mW average power, approaching that available for battery operation. Although Taguchi sensors are another example of a type of sensor that can be used in smoke detectors of this disclosure, due to questions about acceptance by the fire detection community, uncertainty about lifetime and calibration, and their lack of specificity for smoke combustion products, Taguchi sensors may not be as desirable as other types of sensors.

Prototype Design & Construction

FIGS. 2-6 illustrate schematics of a prototype home smoke alarm that has been constructed using multiple sensors integrated by an inexpensive MSP430 microcontroller. This demonstration prototype smoke alarm has been constructed using sensor components that have been well proven for use in residential smoke alarms. In fact, the sensors were selected from manufactured smoke alarms. However, the sensors used in this exemplary prototype provided analog output signals rather than using application-specific integrated circuits (ASICs) that are frequently used for aerosol sensors. These signals are converted to digital signals by the central microcontroller in the prototype that is also used also for power management and alarm generation. The microcontroller and overall design also is configured to process data and determine alarm conditions using linear discriminant analysis.

Figure 2:
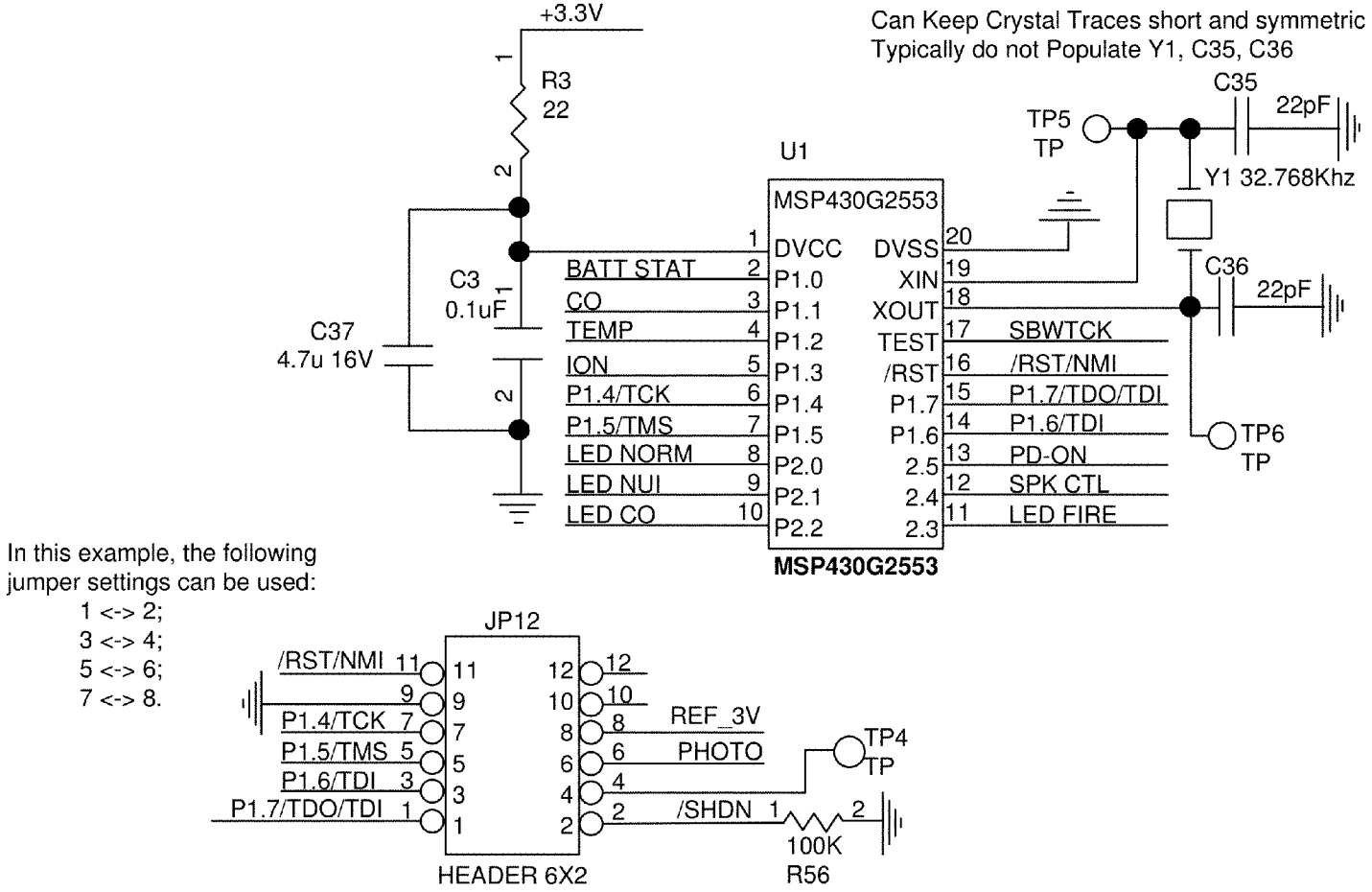
FIG. 2 illustrates a schematic of a representative processor in the form of a microcontroller and its connections to the sensors in FIGS. 3-6.
Figure 3:
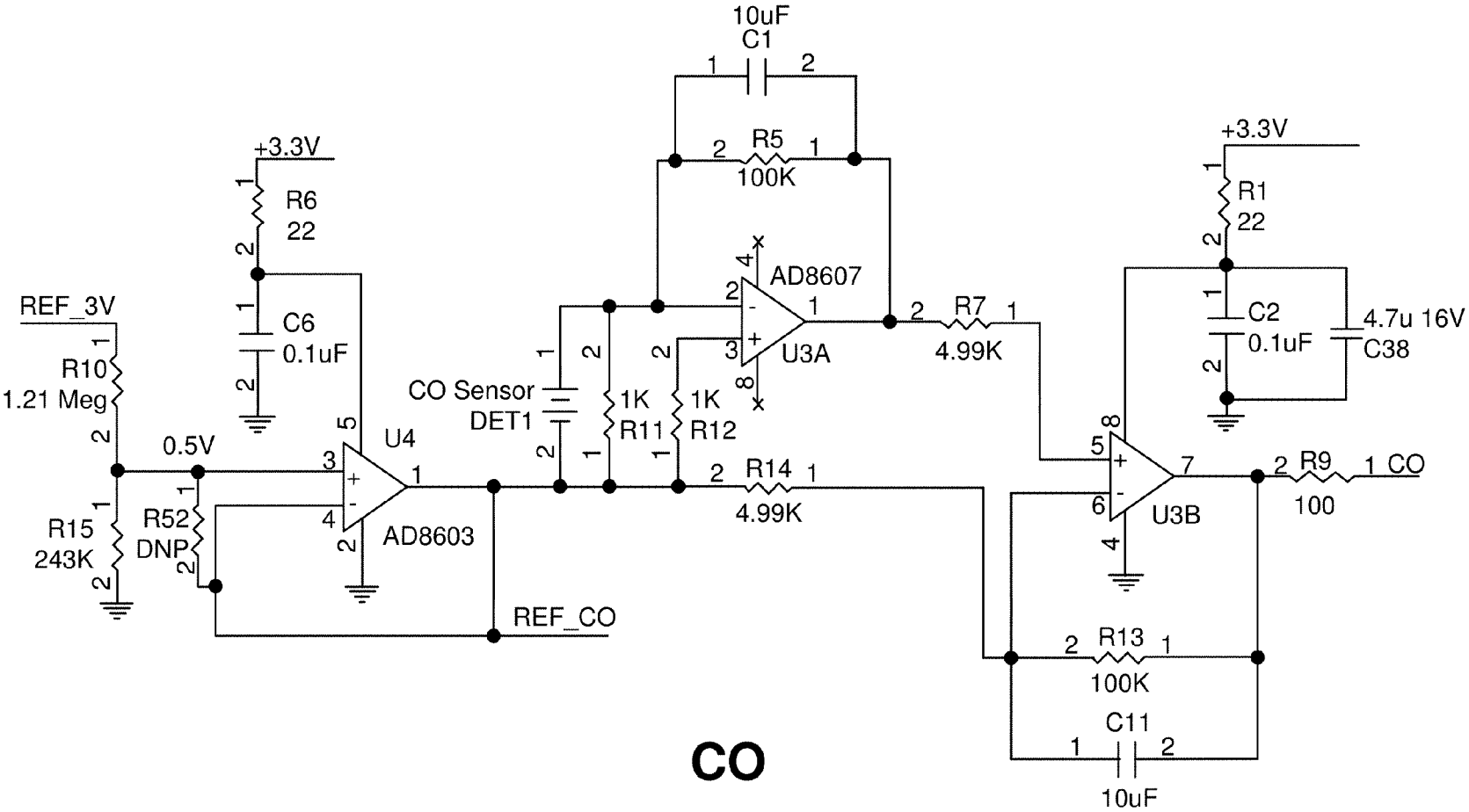
FIG. 3 illustrates a schematic of a representative sensor, specifically a carbon monoxide sensor.
Figure 4:
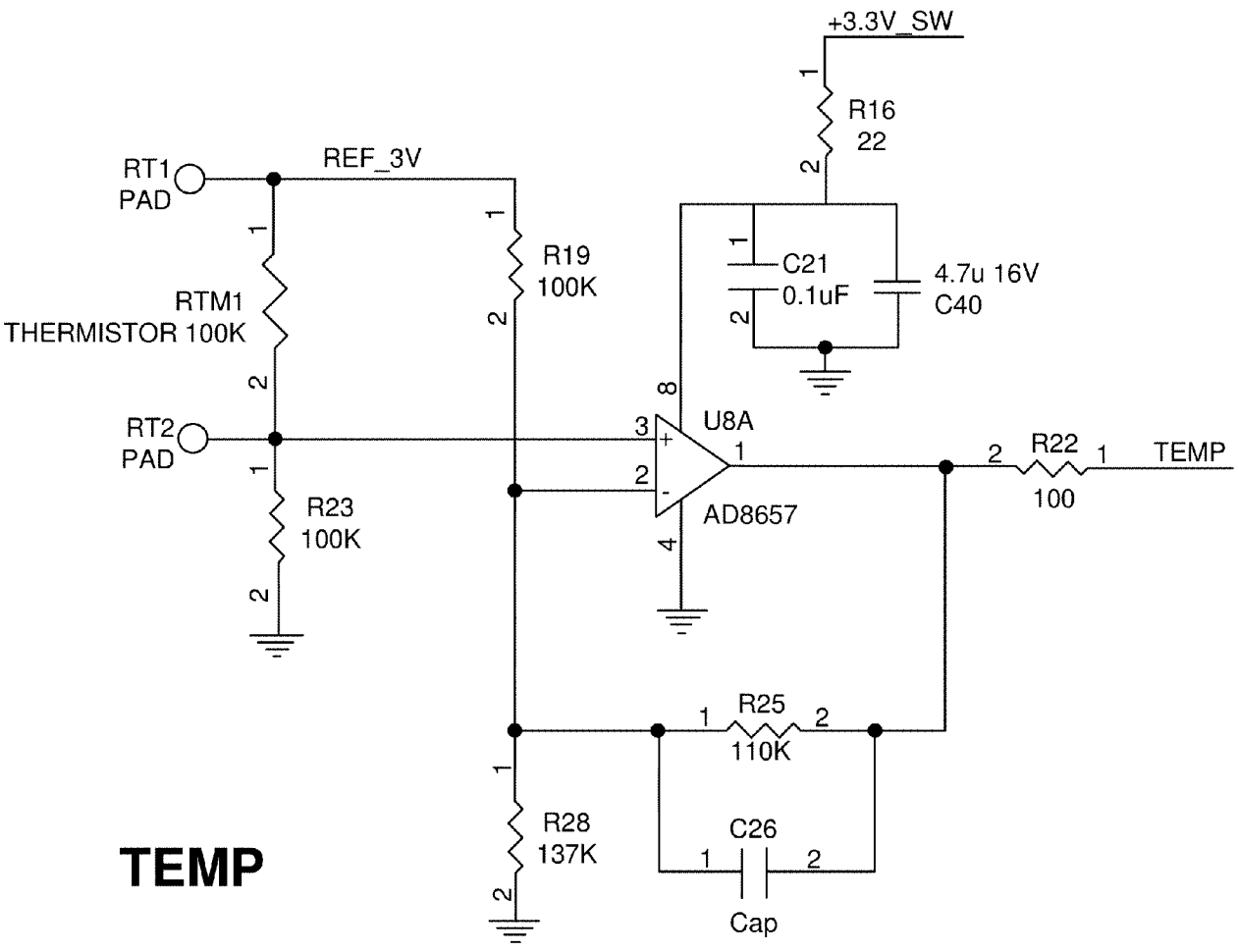
FIG. 4 illustrates a schematic of a representative sensor, specifically a temperature sensor.
Figure 5:
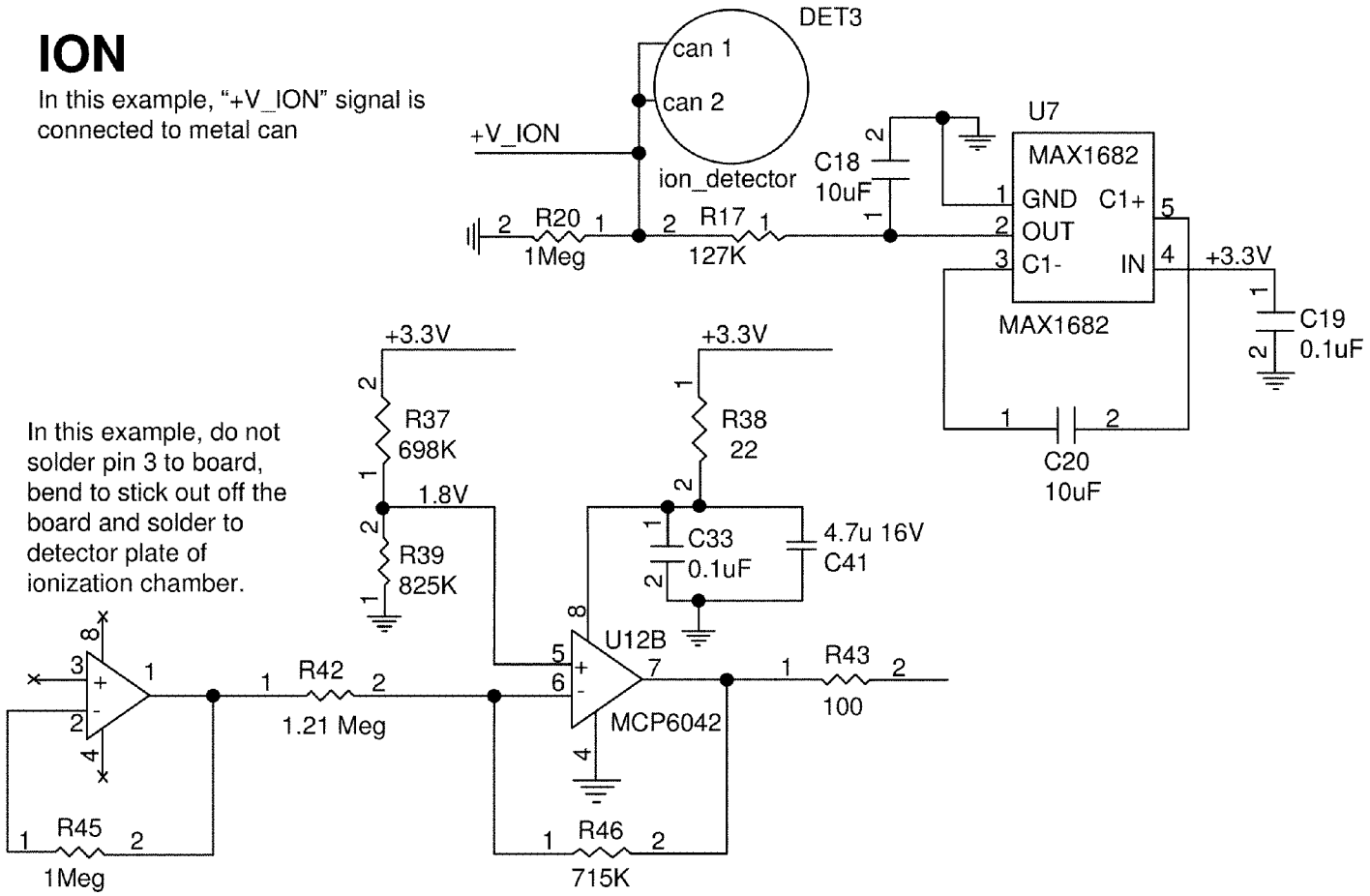
FIG. 5 illustrates a schematic of a representative sensor, specifically an ionization aerosol sensor.
Figure 6:
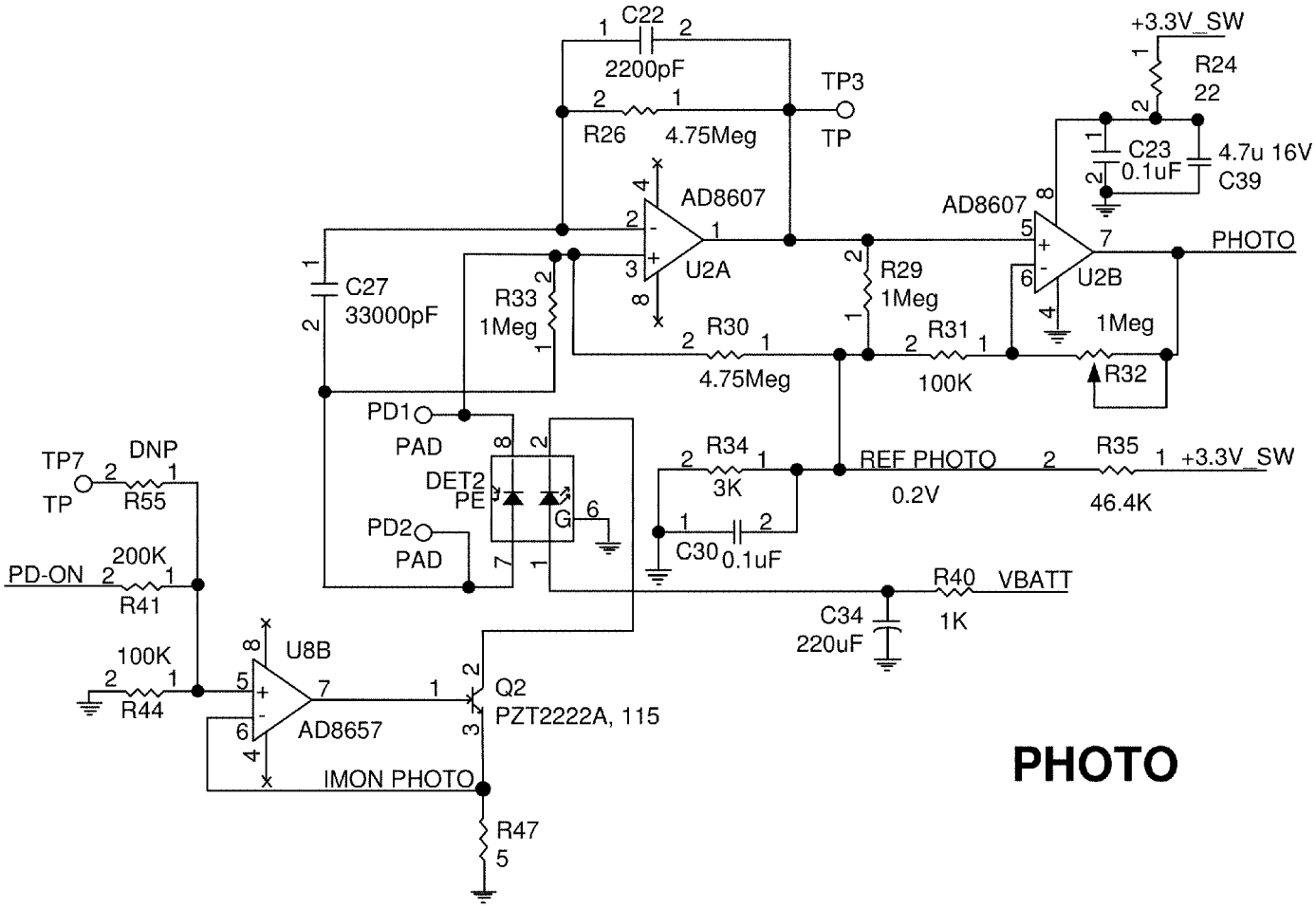
FIG. 6 illustrates a schematic of a representative sensor, specifically a photoelectric aerosol sensor.

FIG. 2 illustrates a schematic of a representative microcontroller and its connections to the sensors in FIGS. 3-6. The MSP430 integrates a processor (a 16-bit RISC CPU, in this example), an ADC, and storage (FRAM, in this example) onto a single integrated circuit. FIGS. 3-6 illustrate schematics of representative sensors. Specifically, FIG. 3 illustrates a schematic of a carbon monoxide sensor; FIG. 4 illustrates a schematic of a temperature sensor; FIG. 5 illustrates a schematic of an ionization aerosol sensor; and FIG. 6 illustrates a schematic of a photoelectric aerosol sensor.

The prototype circuit allows up to four sensors to be populated and used for discrimination, including ionization, photoelectric, carbon monoxide (CO), and temperature sensors. Alternative designs can use more or fewer sensors. Baseline subtraction and rate of change were also implemented along with a simple set of threshold alarms. A low-frequency speaker (e.g., 520 Hz) was added for improved alerting. The assembled prototype included components mounted on a custom printed-circuit board and enclosed in a custom shell, fabricated using a three-dimensional plastic printer. The prototype served to demonstrate a practical multiple-sensor smoke alarm that employs linear discriminant analysis.

In FIG. 3, the CO sensor produces current (about 2.4 nA/ppm) that is converted by a high-impedance amplifier to a voltage, offset by 0.5V. In FIG. 4, the thermistor is connected to an amplifier circuit designed to correct for nonlinearity. In FIG. 5, the ionization-type aerosol sensor operates by using a high-impedance amplifier to monitor the voltage on an internal plate that changes when excess charge accumulates due to aerosol particles inside the sensor. A voltage-doubling integrated circuit (such as a MAX1682 circuit available from Maxim Integrated) is used in this example to bias the outer shell of the ion sensor to +6.6V. In FIG. 6, the photoelectric-type aerosol sensor monitors the scattered light from aerosol particles illuminated by an infrared light-emitting diode (LED). The LED is pulsed by the microcontroller, which waits about 300 μs to allow settling before reading the scattered-light photodiode.

The electronics of the exemplary prototype are powered by three AA batteries regulated to 3.3V plus a 3.0V reference voltage (power supplies not shown) for the analog-to-digital converter (ADC). Power is conserved between reading cycles by having the microcontroller switch off the 3.3V regulator that supplies power to all amplifiers, except for the ionization circuit, which consumes negligible power. The microcontroller is then set into a sleep mode for 3-10 seconds, after which power is reapplied to all circuits for another reading cycle.

A speaker (not shown) is used to sound lower-frequency alarms deemed to improve alerting. Studies of various groups of subjects, including children and the elderly, tested for their ability to hear various alarm signals, have shown that voice alarms and a lower-pitch signal prompted better alerting than high-pitched sounds (Ahrens, M. (2008). "Home Smoke Alarms: The Data as Context for Decision." *Fire Technology* 44: 313-27). In particular, Thomas and Bruck have found that a 520-Hz square-wave auditory signal is much more effective than the currently used 3100-Hz T-3 alarm signal (Thomas, I. and D. Bruck. "Awakening of Sleeping People: A Decade of Research." *Fire Technology* 46(3): 743-61). The widely spaced overtones produced by the square-wave excitation of the voice-coil speakers appear to be important in the alerting action. In the prototype, the battery is directly connected to the 8-ohm speaker through a switching transistor (not shown). If a fire alarm is warranted, the microcontroller switches the transistor at a 520-Hz frequency in a T-3cycle. If a CO toxic alarm is warranted, a T-4 cycle can be used.

Exemplary Training Methods

Figure 7:
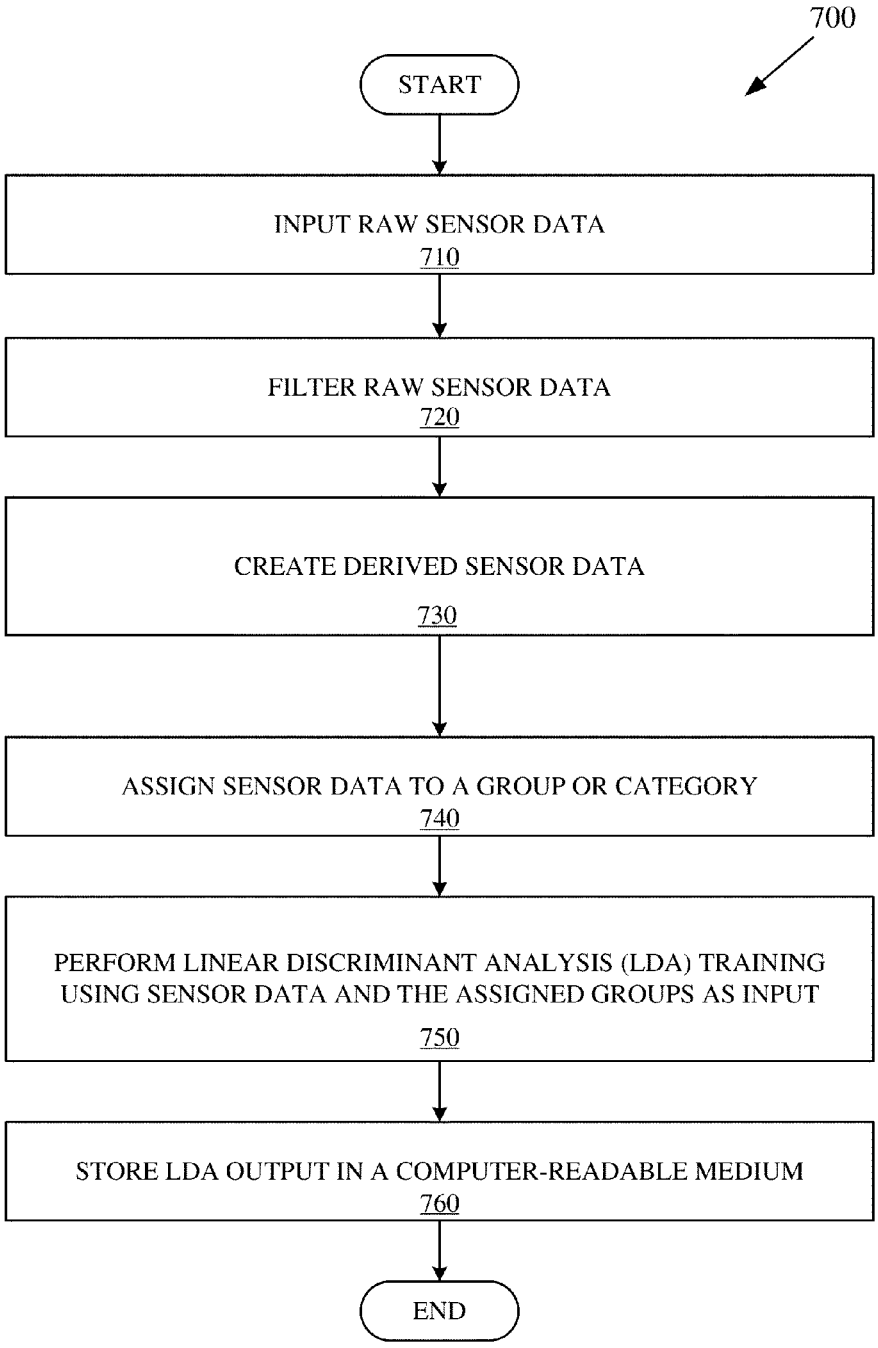
FIG. 7 illustrates an embodiment of a method of training a classifier for a smoke detector.

FIG. 7 illustrates an embodiment of a method of training a LDA classifier for a smoke detector. The method begins at 710 by inputting raw sensor data from a plurality of tests or experiments. The data may be collected by performing experiments that are monitored by one or more sensors over the course of the experiment. The experiments include various non-hazardous and hazardous conditions. For example, experiments can include events that can be classified as "normal," "non-flaming" or "smoldering," and "flaming." As another example, experiments can include events that can be classified as "normal," "nuisance," "smoldering," "grease fire," and "flaming." The experiments can include events such as "toxic gas present," where the toxic gas can be carbon monoxide or other toxic gases. Alternatively, the raw sensor data can be data collected from prior tests, such as published data that is available from the Underwriter's Laboratory (UL) and the National Institute of Standards and Technology (NIST).

For example, training data for LDA transformations can be UL and/or NIST test data from a series of tests for a variety of flaming and non-flaming (smoldering) categories. In one test, a coffee maker was set on fire and monitored for a period of time. The environment containing the coffee maker was monitored by one or more sensors, such as an ion sensor and a temperature sensor. The test data from the test is a time-series of sensor data corresponding to data from each sensor. The first three columns (Raw Data ($V_i$)) of FIG. 8 show a small sample of the time and sensor data that would be observed by a representative analog-to-digital converter (ADC) connected to temperature and ionization sensors.

Returning to FIG. 7, the raw sensor data can be processed. Processing can include using a processor to perform filtering (720), creating derived signal data (730), or combinations thereof. For example, at 720, the raw sensor data is filtered. Filtering can include removing faulty sensor data from the raw sensor data. If a sensor appears to be faulty during an entire experiment, the entire time-series of sensor data corresponding to the faulty sensor can be removed from the raw sensor data. Alternatively, if a sensor appears to be intermittently faulty, portions of the time-series of sensor data corresponding to the faulty data can be removed from the raw sensor data.

Filtering can include standardizing or normalizing raw sensor data. Normalizing raw sensor data can include adding or removing data from the raw sensor data. For example, it may be desirable for the time-series of sensor data to have the same sample rate for each sensor. However, the raw sensor data may include sensors that have been sampled at different sampling rates. For example, a carbon monoxide sensor may be sampled every three seconds and a photoelectric aerosol sensor may be sampled every six seconds. In this example, filtering can include interpolating between photoelectric aerosol sensor samples to create an interpolated value between the actual samples. Thus, the photoelectric aerosol sensor data can be modified to include a sample for every three seconds to match the sampling period of the carbon monoxide sensor. Filtering can also include removing samples. For example, every other carbon monoxide sample could be removed to match the six second sampling period of the photoelectric aerosol sensor.

Filtering can also include selecting sensor data to keep or remove for a given smoke detector placement. For example, it may be desirable to tune a smoke detector for primary placement in a bedroom or a kitchen. Sensor data from tests that are likely to be applicable to the given placement can be kept and sensor data that is less likely to be applicable to the given placement can be removed. For example, data from grease fire tests may be more applicable for a smoke detector placed in a kitchen than in a bedroom. Thus, data from grease-fire tests can be kept for a smoke detector tuned for placement in a kitchen and removed for a smoke detector tuned for placement in a bedroom. As another example, alerting for smoldering fires may be more important in a bedroom since sleeping occupants may be unaware of a smoldering fire. In the kitchen, a smoldering fire may be less likely or may potentially cause more false alarms. Thus, data from smoldering tests can be removed for a kitchen smoke detector and kept for a bedroom smoke detector, for example.

At 730, derived sensor data is calculated from the sensor data. In general, the set of derived sensor data represents signals that are available or that can be calculated in an LDA smoke detector. Derived sensor data can include applying various scaling factors for weighting data from the various sensors. For example, different sensors may output different ranges of sensor data values over environmental conditions of interest. For example, carbon monoxide sensor data may range from 0 corresponding to 0 parts per million (ppm) during normal conditions and 100 corresponding to 100 ppm at the onset of fire conditions and, aerosol sensor data may range from 0 corresponding to 0 obscuration during normal conditions and 0.15 corresponding to 0.15 obscuration at the onset of fire conditions. In one embodiment, the different sensor data ranges can be normalized by applying different scaling factors to respective sensors. In this example, carbon monoxide sensor data can be divided by 100 and aerosol sensor data can be divided by 0.15 so that the derived sensor data for each sensor ranges from 0 during normal conditions to 1 at the onset of fire conditions. In an alternative embodiment, the LDA sensitivity of one sensor relative to another sensor can be adjusted by selection of the weighting factors. In other words, the LDA can be made more (or less) sensitive to a given sensor. In this example, the LDA can be made more sensitive to carbon monoxide than aerosols by dividing the carbon monoxide sensor data by 50 (so the derived signal data ranges between 0 and 2) and dividing the aerosol data by 0.15 (so the derived signal data ranges between 0 and 1).

Derived sensor data can include the rate of change of filtered sensor data. Derived sensor data can also include one or more baselines calculated for each time-series of filtered sensor data corresponding to a sensor. As one example, a baseline can be a moving average, such as a simple moving average, a cumulative moving average, or a weighted moving average. Multiple baselines can be calculated for one time-series of sensor data. In other words, more than one moving average can be calculated for a given sensor. The baselines $B_i$ can be calculated using a moving average of n previous measurements, where n can be chosen according a time interval during which a signal change would be significant.

The variable can be large to account for slow changes in sensor baseline, perhaps caused by environmental drift in temperature, humidity, or aerosols, for example. Changes over shorter time intervals are more likely due to changing conditions due to fires, so additional derived signals with moving averages over shorter intervals, such as 5-10 minutes duration can be appropriate. Either or both longer and shorter baseline averages can be utilized. In addition, more than two baseline averages can be available. The period over which the baseline average is calculated can be varied by varying the sample rate of the sensor and n. If the smoke alarm samples every 3 seconds, for example, setting $n=2^{13}$ would correspond to a moving baseline average over about 6.8 hours, while a second setting of $n'=2^7$ would correspond to a moving baseline average over about 6.4 minutes. Thus, moving baseline averages can be calculated for the ranges of 5-10 minutes or 5-10 hours, or over other time intervals by varying n, for example. Factors for selecting the period of the baseline can include the sensitivity of the sensor, the noise associated with the sensor, and the characteristics of the smoke and/or fire conditions associated with the sensor.

In FIG. 8, three baselines are calculated, one for the temperature and two for the ionization signal. For the temperature baseline, labelled "T_base," the average is over 32×10 seconds=320 seconds or about 5.3 minutes. Similarly, the ionization sensor data is used to provide two moving averages over 64 data points ("IonS_base") and over 2048 data points ("Ion_base"). These correspond to moving averages over about 10.7 minutes and 5.7 hours, respectively.

Baseline values can be calculated using a simple moving average of n previous points, where the initial data point is considered to repeat indefinitely into the past. Alternatively, successive baseline values $B_i|_{new}$ can be calculated from the previous baseline values $B_i$ and successive readings $V_i$ of the ADC reading from each of the sensors according to a limited variant of the cumulative moving average formula:

$$B_i|_{new}=[nB_i-B_i+V_i]/n \tag{1}$$

Because microcontrollers can efficiently perform integer multiplication and division in powers of two using register shifts, it is convenient that $n=2^m$ where m is an integer. In the present example, n is chosen to be $2^5=32$, $2^6=64$, and $2^{11}=2048$, for the three baselines, respectively. FIG. 8 shows baselines calculated using Eq. (1).

Derived sensor data can include a difference between the filtered sensor data and the moving average of the filtered sensor data corresponding to one or more sensors. In FIG. 8, "LD Signals ($S_i$)" are derived data representing raw sensor data offset by the baseline values:

$$S_i=V_i-B_i \tag{2}$$

Derived sensor data can include the addition of sensor variance in the training data. For example, if the manufacturing tolerance for the sensitivity of a sensor is ±10%, then additional sets of training data can be obtained by incorporating variants of the original training data in which the sensor data for each additional set are multiplied by 1+x where x corresponds to the tolerance, such as x ranging from −10% to +10% for each additional set. In this way, realistic variations in sensor performance can be incorporated in the LDA without requiring numerous experimental tests to establish the training data.

Returning to FIG. 7, at 740, sensor data is assigned to a group or category. In one embodiment, the sensor data is assigned on a per experiment basis. Thus, the sensor data for one experiment is associated with a single classification. For example, sensor data from the flaming coffee maker experiment could be assigned to the "flaming" group. As another example, sensor data from a smoldering chair experiment could be assigned to the "smoldering" group. In an alternative embodiment, the raw sensor data or the derived sensor data for a given time period or time interval within an experiment can be assigned to a group, with different groups being assigned to the data from different time periods. Thus, the time-series of sensor data can be divided into different time periods and each time period can be associated with a determined category that can be the same or different depending on the data. Each of the categories can be associated with a hazardous or a non-hazardous condition.

For example, data from a single smoldering chair experiment may be divided into time periods that could be assigned to the "normal," "smoldering," and "flaming" groups. The normal group is associated with a non-hazardous condition and the smoldering and flaming groups are associated with a hazardous condition. At the beginning of the experiment, the smoldering chair may not give off much heat, smoke, and/or carbon monoxide and the sensor data for that period may be assigned to "normal." As the experiment progresses, the output of heat, smoke, and/or carbon monoxide may progress and the sensor data for that period may be assigned to "smoldering." Near the end of the experiment, the chair may burst into flames and the sensor data for that period may be assigned to "flaming."

In one embodiment, the assignments can be made by an observer of the experiment noting the time of each event during the experiment. In an alternative embodiment, the assignments can be made by examining the time-series of sensor data. For example, a person skilled in the art of detecting fires from sensor data could assign groups to the periods of time based on his or her knowledge of the output of various sensors for different types of smoke and fire events. In yet another embodiment, processor implemented rules can be set to assign groups to the time periods of a time-series of sensor data. For example, a temperature rise above a threshold value can be established as a rule indicating a transition into the "flaming" category. As another example, a carbon monoxide level above a threshold without an abrupt rise in temperature can be established as indicating a transition into the "smoldering" category. As another example, when all sensors are below their corresponding alarm thresholds, a rule can assign data to a "normal" category.

During some time periods of an experiment, the sensor data may be inconclusive, such as when transitioning from one category to a different category. During other periods of an experiment, the sensor data may be extreme (such as when a fire is at its most intense level) and less useful for detecting the onset of a hazardous event. Assignment of the sensor data to a category may include excluding extreme or inconclusive sensor data from any category. Extreme sensor data can include sensor data that exceeds a pre-defined threshold for the sensor data of a given sensor. For example, extreme sensor data can include sensor data values that are greater than twice the sensor data values at the onset of an alarm.

For the UL tests, data near the start of each test (t=0 seconds) may be given the group assignment of "normal" since the signals did not deviate significantly from those at the start. For example, in FIG. 8, the data through time 100 is classified as "normal." UL gave the coffee maker test a "flaming" assignment based upon the point at which a commercial smoke alarm device turned on its alarm. In the actual test, the commercial smoke alarm device turned on its alarm at 210 seconds when Δion=382.9. In the present example, the "flaming" assignment was given to time-resolved points that had values of the signal "Δion" greater than 25 percent of the value at the time of alarm (382.9*25%=95.7). The point at 110 seconds is excluded due to its transitional nature. The points in the test after 210 seconds are excluded due to their extreme nature, where the "IonS_base" derived signal is about twice its value at the onset of being assigned to the flaming group (at 120 seconds).

Returning to FIG. 7, at 750, sensor data and the group assignments for each test and/or periods of each experiment are used as training input to a linear discriminant analysis (LDA). Raw sensor data, filtered raw sensor data, derived sensor data, and/or combinations thereof can be used to train the LDA. Using the same set of tests, different combinations of sensor data can be used to train different smoke detectors. For example, the training data may include data samples taken from a photoelectric aerosol sensor, an ionization aerosol sensor, a temperature sensor, and a carbon monoxide sensor. A first smoke detector may have only an ionization aerosol sensor. Training data for the first smoke detector can be limited to data and/or derived data corresponding to an ionization aerosol sensor. On the other hand, a second smoke detector may have an ionization aerosol sensor and a carbon monoxide sensor. Training data for the second smoke detector can include data and/or derived data corresponding to an ionization aerosol sensor and a carbon monoxide sensor. In one embodiment, the signals $S_i$ (from FIG. 8) are used as input data for LDA training along with the assignment of the time-resolved data to a group.

It will be understood that the training data for the LDA typically contains numerous tests taken under a variety of conditions, and each test would typically have baselines and assignments performed in a similar manner, e.g. according to steps 710-740, to the flaming coffee maker data in FIG. 8. In the UL and NIST tests, some tests were generally considered "flaming" because flames were quickly apparent after test initiation (t=0 seconds) or "smoldering" because flames were not apparent until late in the tests.

LDA training can be performed upon the preprocessed data to yield a uniquely determined solution. A variety of software packages executed on a variety of computing platforms can be used for LDA training. Representative non-limiting examples of computing platforms include personal computers (Windows or MacOS) and UNIX or LINUX workstations. Representative non-limiting examples of software packages include "R," Mathematica, Matlab, SAS, SPSS, and Stata. For example, the open-source statistical software program "R" can be used along with a library package "MASS" with the routine "lda( )." For the present example, the input is a data matrix with the number of rows equal to the number of observations in the training data, nobs, and np=3 columns, the 3 columns labelled "LD signals" in FIG. 8. A vector of length nobs with group membership is also input, the "Assigned Group" column in FIG. 8. Equal priors can be specified in a vector of length ng, the number of groups, each with value 1/ng, although other values may be used. In this example ng=3 for groups "Normal," "Flaming," and "Smoldering" with the priors for each of ⅓.

The output of LDA training includes a plurality of coefficients, and desirably a plurality of constants and a plurality of centroids. Each centroid can correspond to one of the predetermined groups. Tables 1 and 2 (below) illustrate the object output data from lda when using the UL tests processed in accordance with steps 710-750.

Table 1 illustrates the coefficients and constants determined in the example LDA. The $C_i$ constant terms are the means of the group means in this example. $C_{LD1i}$ and $C_{LD2i}$ are coefficients to transform the respective signals into linear discriminant (LD) coordinates and have been multiplied by 4096.

| Signal | $C_i$ | $CLD1_i$ | $CLD2_i$ |
|---|---|---|---|
| ΔT | 14 | 860 | −19 |
| ΔionS | 77 | 87 | −276 |
| Δion | 97 | −30 | 350 |

Table 2 illustrates the average LD coordinates ($LD1_k$, $LD2_k$), e.g., centroids, of the training data associated with each of the assigned groups.

| Group | $LD1_k$ | $LD2_k$ |
|---|---|---|
| Normal | −4 | −3 |
| Flaming | 7 | 0 |
| Smoldering | −3 | 3 |

Returning to FIG. 7, at 760, LDA output is stored in a computer-readable medium. The output from LDA training provides a set of terms that can be employed for classification of observations by relatively simple computing platforms, including, but not limited to, inexpensive microcontrollers used in modern home smoke alarms. For example, the plurality of coefficients, the plurality of constants, and the plurality of centroids generated by the LDA at 750 can be stored in storage or memory 120 of the system 100 so that the system 100 is trained to detect hazardous environmental conditions. The LDA output can also be stored in the storage or memory of more complex systems such as those employed in fire control panels of commercial fire monitoring systems so that classification can be performed on more complex systems.

Exemplary Detection Methods

Figure 9:
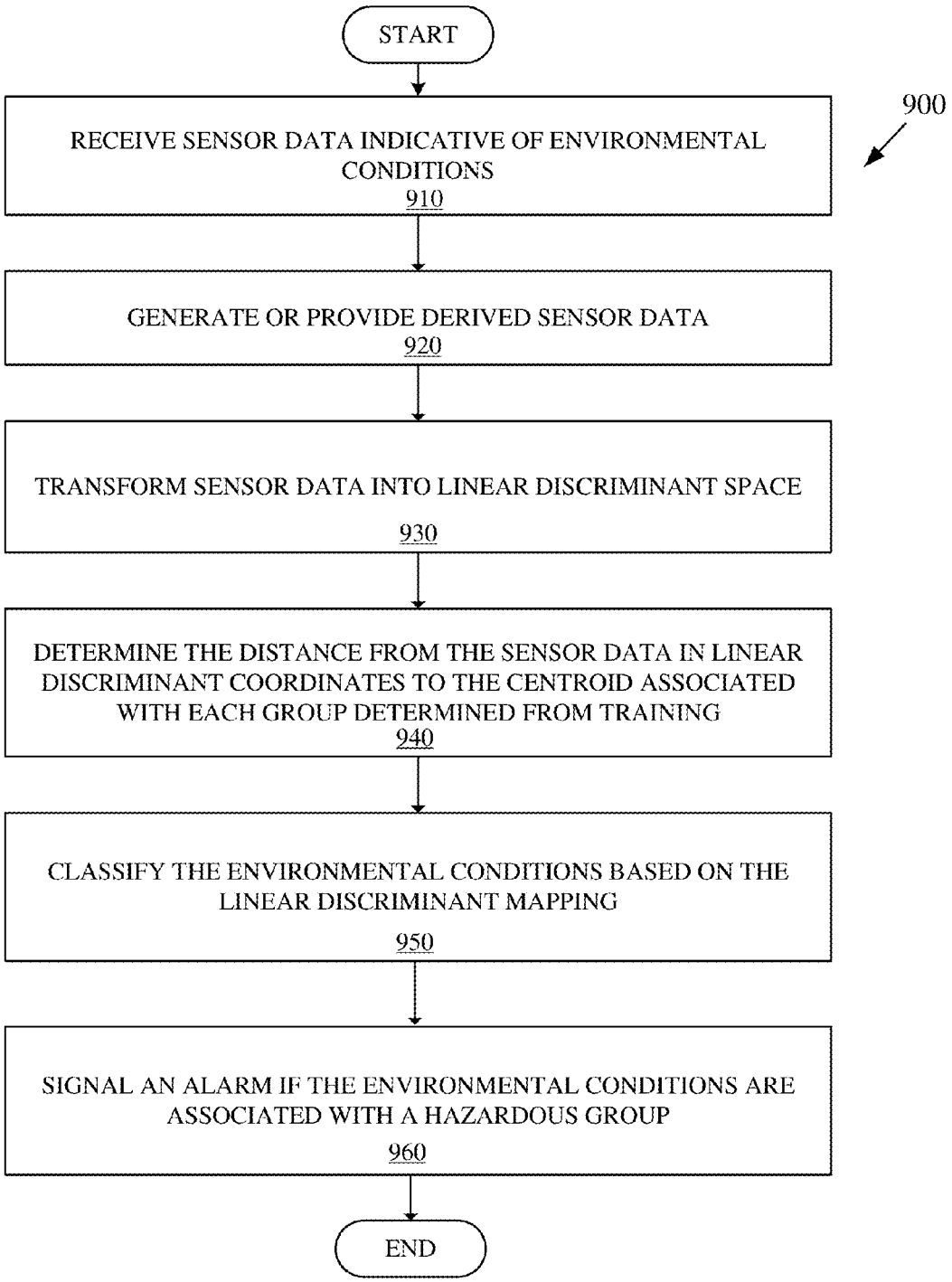
FIG. 9 illustrates an embodiment of a method for a smoke detector.

FIG. 9 illustrates an embodiment of a method for a smoke detector, such as a smoke detector configured in accordance with FIG. 1, or FIGS. 2-6, for example. The method can be used to detect a hazardous environmental condition, such as a fire or the presence of toxic gas. The method begins at 910, where sensor data that is indicative of present environmental conditions is received. The sensor data can include data from an aerosol sensor (photoelectric or ionization), a temperature sensor, a carbon monoxide sensor, a carbon dioxide sensor, and/or a Taguchi sensor, for example. As described above with reference to LDA training, the types of sensors included in the smoke detector should correspond to the sensors used for LDA training of the smoke detector.

For the remainder of the "Exemplary Detection Methods" section, a specific example is given of calculations performed by a microcontroller connected to analog voltage signals from a temperature sensor and an ionization-type aerosol detector. The data originates from a specific test fire (UL: F Coffee maker 12134) used for LDA training that incorporated a full suite of tests. In FIG. 10, the raw data (Raw data ($V_i$)) is given in analog-to-digital converter (ADC) units for the temperature and ionization sensors.

Returning to FIG. 9, at 920, derived sensor data is generated based on the received sensor data. In one example, the raw data can be preprocessed by baseline correction and calculation of a rate of change. For baseline calculations, moving averages over various time intervals can be used. In one embodiment, the baseline multiplied by n is stored (i.e., store $nB_i$). The baseline is updated using the ADC value of the signal $V_i$. In the present example, the value of i ranges from 1 to 3, representing each of the three signals used (ΔT, ΔionS, and Δion).

$$nB_i|_{new} = nB_i - \frac{nB_i}{n} + V_i \qquad (3)$$
$$B_i|_{new} = nB_i|_{new}/n$$

It is preferable to use the same value of n used to calculate the baselines that were used in the LDA training. In FIG. 10, the column labeled "T_b*32" corresponds to the temperature baseline times 32, or equivalent to $32B_{temperature}|_{new}$. The time interval over which the baseline is calculated is n times the reading interval between successive sensor readings, which in the example is 10 seconds. In this case, the average is over 32×10 seconds=320 seconds or about 5.3 minutes. The column labeled "T_base" corresponds to the temperature baseline, which is calculated by dividing by 32 the data in the column labeled "T_b*32". Similarly the ionization sensor data is used to provide two moving averages over 64 data points ("IonS_base") and 2048 data points ("Ion_base"). These correspond to moving averages over about 10.7 minutes and 5.7 hours, respectively.

In an alternative example, the baseline multiplied by $2^n$, (e.g., $2^bB_i$) can be stored for baseline calculations, and the baseline can be updated using the ADC value of the signal $V_iV_i$.

$$2^nB_i|_{new} = 2^nB_i - \frac{2^nB_i}{2^n} + V_i \qquad (4)$$
$$B_i|_{new} = 2^nB_i|_{new}/2^n$$

Division by $2^n$ $2^n$ can be accomplished by a microcontroller register shift of n places to the right. The time interval over which the baseline is calculated in $2^n$ times the reading interval. For example, if the reading interval is 10 seconds, setting n=11 corresponds to a moving average over approximately 8 hours. Typically, a 32-bit integer can be used to store $2^nB_i$.

After calculating baselines for the sensor data, the sensor data may be further processed. For example, the sensor data may be normalized by subtracting the respective baselines $B_i$ and constants $C_i$ (or the mean of the group means) predetermined by the training phase of the LDA:

$$S_i = V_i - B_i - C_i \qquad (5)$$

The Ci values for this example are shown above in Table 1. Thus, the data in columns labeled ΔT, ΔionS and Δion of FIG. 10 correspond to the three LD signals $S_i$ of FIG. 8 used to train the LDA.

Returning to FIG. 9, at 930, sensor data is transformed into LD coordinates (LD1, LD2) using the set of coefficients predetermined by LDA training. The coefficients $C_{LD1i}$ and $C_{LD2i}$ are also shown in Table 1 above for the example LDA. Since the coefficients have been multiplied by 4096 in this example to enable accurate calculation by integer arithmetic, the products are divided by 4096 to determine the LD coordinates.

$$LD1 = \Sigma_{i=1}^{3}(C_{LD1i}S_i)/4096$$

and $$LD2 = \Sigma_{i=1}^{3}(C_{LD2i}S_i)/4096 \qquad (6)$$

At 940, the Cartesian distance from the sensor data in LD coordinates (LD LD2) to each of the average LD coordinates ($LD1_k$, $LD2_k$) or centroids for each group can be determined. Coordinates for "normal," "flaming," and "smoldering" are listed for the example in Table 2. The distances squared, $R_k^2$, to each centroid are $$R_k^2 = (LD1_k - LD1)^2 + (LD2_k - LD2)^2 \qquad (7)$$

At 950, the environmental conditions are classified based on the LD mapping. In one embodiment, classification can be performed by determining which centroid is the nearest to the current LD coordinates (LD1, LD2). The minimum distance can be used to assign the group as is shown in the example in FIG. 10. At time 0 to time 110, the nearest (closest distance-wise) centroid is the centroid associated with the normal group. At time 120 and above, the nearest centroid is the centroid associated with the flaming group.

Alternatively, circular and non-circular thresholds can be used to qualify classification to particular groups. Generally, the classification of the present environmental conditions as belonging to a particular group can be based on the linear discriminant mapping being outside a threshold in linear discriminant coordinates. In one example, the classification can be based on the linear discriminant mapping being on one side of a linear or non-linear curve in two-dimensional linear discriminant coordinates. For example, the classification of "normal" could be chosen unless either LD1 is greater than 0 or LD2 is greater than 0. As another example, the classification can be based on the linear discriminant mapping being on one side of a planar or non-planar surface in three-dimensional linear discriminant coordinates.

Returning to FIG. 9, at 960, an alarm could be signaled if the classification is associated with a hazardous group. For example, an alarm can be signaled if either a smoldering or a flaming group is assigned. Alternatively, no alarm will be signaled if the normal or nuisance group is assigned. In one embodiment, the alarm can be signaled via an audible alert. In an alternative embodiment, the alarm can be signaled via a notification sent to a fire control panel or to a monitoring service, for example.

The above approaches do not totally eliminate false alarms, but reduce their number and also often results in a more rapid determination after existence of a fire in comparison to other approaches known to the inventors.

LDA Studies Using Fire Test Data

In this study, training data for LDA transformations were supplied by Underwriters Laboratory, Inc. (UL) (Fabian, T. Z. and Gandhi, P. D. 2007. "Smoke Characterization Project." Northbrook, Ill.: Underwriters Laboratory, Inc.) and National Institute of Standards and Technology (NIST) (Bukowski, R. W. et al. "Performance of Home Smoke Alarms." National Institute of Standards and Technology Technical Note 1455-1, February 2008 Revision) and taken from historical tests of fire and nuisance situations in home dwellings. The UL data was recorded by multiple sensors during 18 fire tests in the UL217/UL268 Fire Test Room. The NIST data were recorded during 21 fires each with multiple sensor locations (67 total) in a manufactured and a two-story home plus 25 nuisance tests. The ceiling sensors common to both UL and NIST tests included photoelectric, ionization, temperature, and CO sensors, as well as commercial home smoke alarms.

Figure 11:
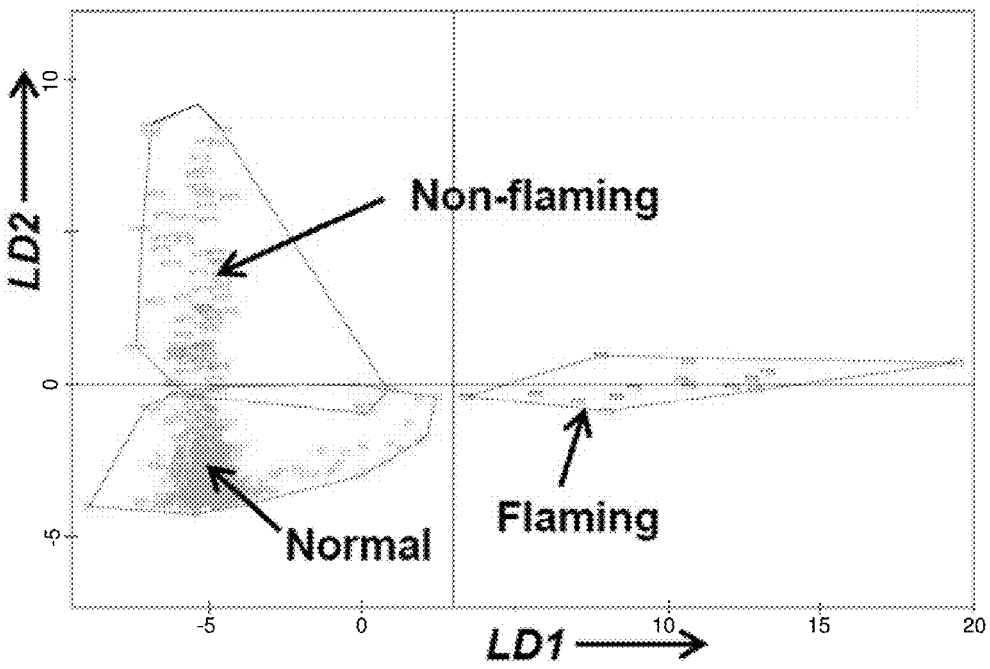
FIG. 11 illustrates an example plot of UL test fire data in linear discriminant coordinates.

An LDA was constructed using the UL fire data with events categorized as flaming or non-flaming fires. Data recorded prior to the onset of the fire was categorized as "normal." Only three channels of data were included in the analysis: 1) the baseline corrected ionization signal, 2) its rate of change, and 3) the rate of change of the temperature. A plot of the first two dimensions in LDA space is shown in FIG. 11. The conditions denoting normal, flaming and non-flaming are generally distinctive with little overlap. This indicates that a smoke detector configured according to this disclosure could detect hazardous conditions if the LDA coordinates were outside of the "normal" region.

Figure 12B:
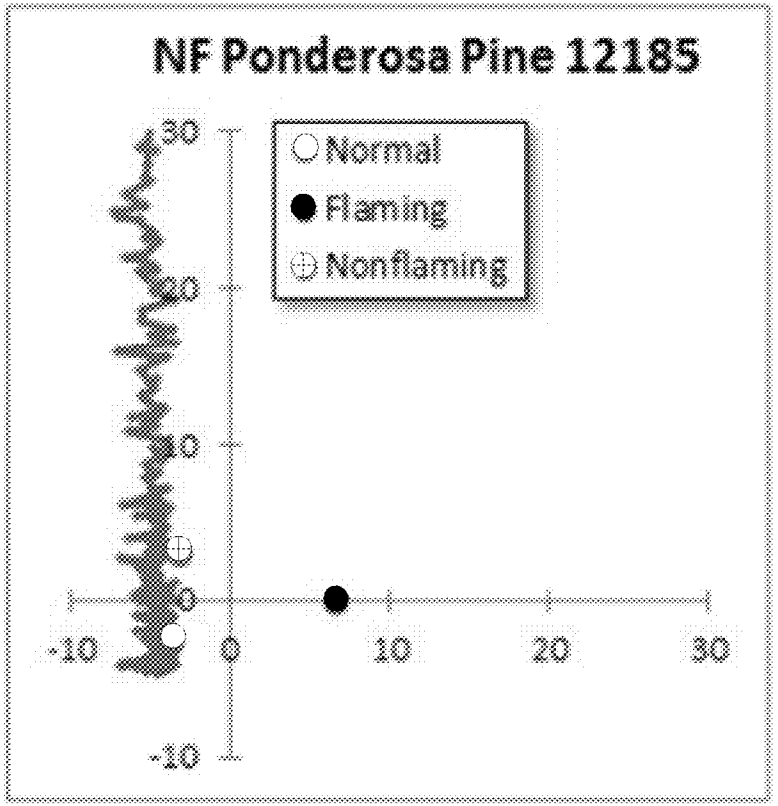
FIGS. 12A-12B illustrate examples of a linear discriminant analysis (LDA) coordinate progression in examples of events to be detected.
Figure 12A:
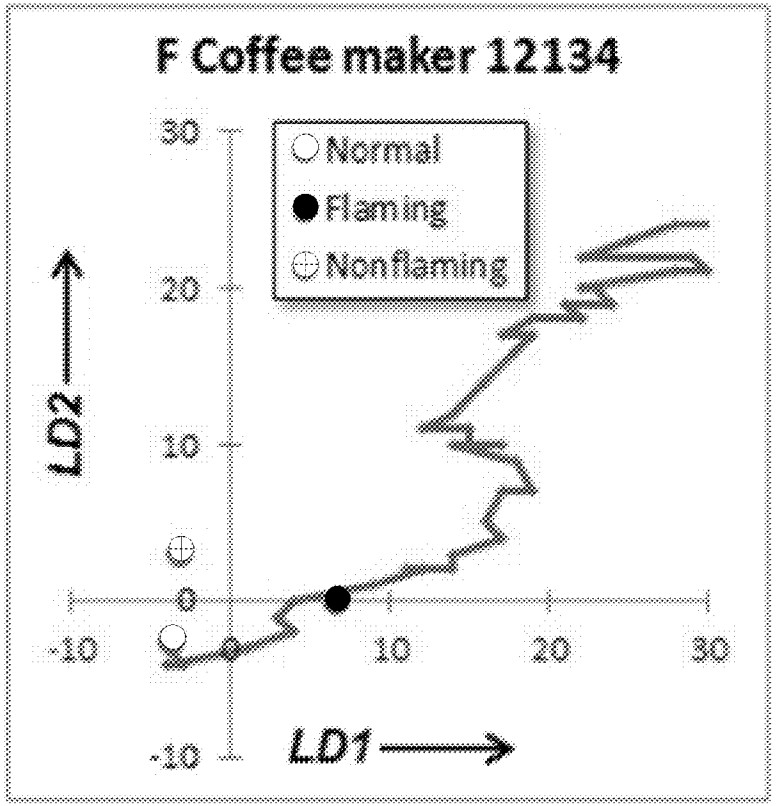

To illustrate the progression of a fire, FIGS. 12A and 12B show the calculated LDA coordinates during two test fires. The coordinates go from normal conditions toward and beyond the centroids expected for flaming and non-flaming fires. Although the LDA coordinates can resolve the differences between the two types of fires, a typical residential alarm system could be configured to emit one alarm sound for either type of fire.

Early detection times are desirable to extend the time for safe egress in emergency conditions. In the flaming fire test shown in FIG. 12A, the commercial alarms sounded at 3.5 minutes for an ionization alarm and 7.3 minutes for a photoelectric alarm. The alarm based upon LDA coordinate proximity to each of the centroids would have triggered at 2.2 minutes or 37 percent faster than the commercial ionization alarm. In the case of the smoldering fire shown in FIG. 12B, the commercial alarms sounded at 45 minutes and 48 minutes respectively, while the LDA alarm would have alerted at 34 minutes or 24 percent faster.

Figure 13:
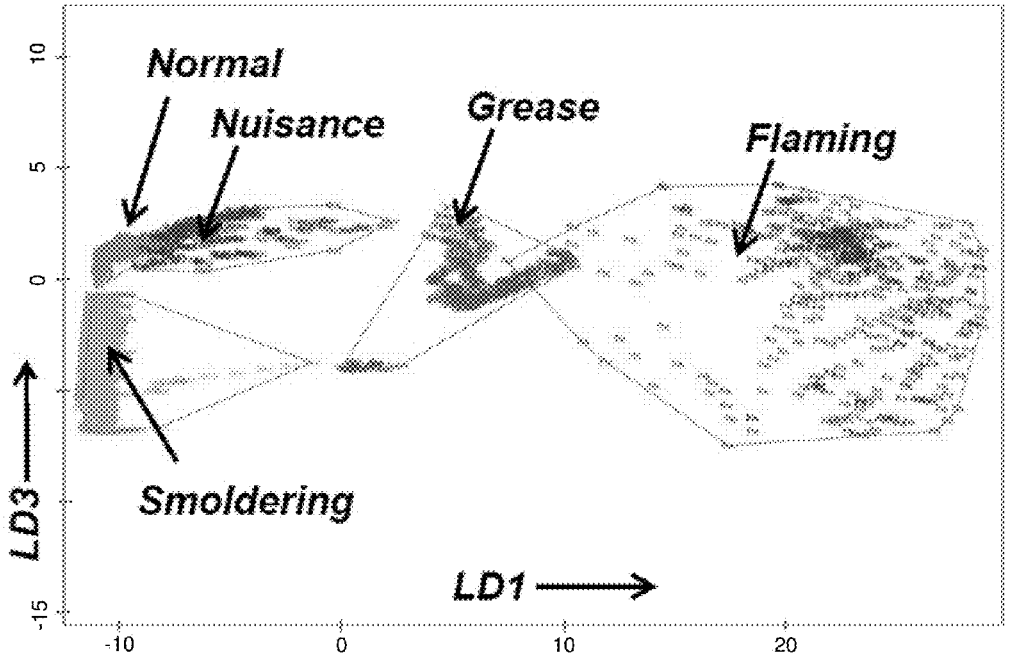
FIG. 13 illustrates an example of NIST fire and nuisance data categorized and plotted in two dimensions of linear discriminant space.

The NIST data includes a variety of fires and nuisance sources, so that response time and false-alarm rejection can be evaluated for various LDAs. Because the characteristics of the fires change during their evolution, groups were more narrowly defined according to sensor response. For example, data were considered as "Flaming" when the rates of increase in temperature and ionization signal were above set thresholds. Conversely, data were considered as "Smoldering" when the rates of increase in temperature and ionization signal were below set thresholds. Other signals can be considered as well in this group categorization. An example is shown in FIG. 13.

The performance of various LDA-based alarms was compared to the commercial alarms used in the NIST tests. Using four sensors, ionization, photoelectric, temperature and carbon monoxide, an LDA alarm would have alerted to the smoldering fires an average of more than 18 minutes faster than a conventional photoelectric-ionization combination alarm. Such an LDA alarm was also found to trigger more slowly than conventional smoke alarms and fully suppress half of the nuisances that triggered false alarms in conventional smoke alarms. In another example using only photoelectric and temperature sensors, an LDA alarm would have alerted to the smoldering fires an average of more than 23 minutes faster than a conventional photoelectric-ionization combination alarm and generally responded more slowly to nuisances but fully rejected about 1 in 5 nuisance sources. Even when a conventional photoelectric sensor was only used, LDA processing was shown to have improved the alerting to smoldering fires by an average of 20 minutes compared to a conventional photoelectric alarm, although there was only a small improvement in false-alarm rejection.

The conclusion is that LDA processing alone can improve response time, at least for smoldering fires, while adding additional sensors can provide enhanced rejection of nuisance sources for false alarms. The addition of carbon monoxide sensing is two-fold: (1) acting as a toxic-gas sensor and (2) acting in concert with smoke sensors for fire detection.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A smoke detector, comprising:

a computer readable medium including linear discriminant analysis (LDA) training output data generated by:

inputting sensor data from a plurality of tests, the sensor data indicative of environmental conditions during the respective tests;

processing the sensor data to generate derived signal data for the respective tests;

assigning at least one group to the derived signal data for the respective tests, the at least one group selected from a plurality of groups, each group of the plurality of groups associated with a hazardous condition or a non-hazardous condition; and performing LDA training using the derived signal data and the assigned at least one group for the respective tests as input to the LDA training, the output of the LDA training generating a plurality of transformation coefficients for transforming derived signal data into linear discriminant (LD) coordinates, a mean of group means, and a plurality of centroids in linear discriminant coordinates, wherein the plurality of centroids includes a different centroid for each group of the plurality of groups;

a plurality of sensors configured to observe present environmental conditions, the plurality of sensors comprising an aerosol sensor and a carbon monoxide sensor;

a processor operatively connected to the computer readable memory and the plurality of sensors, the processor configured to:

process data from the plurality of sensors to provide data in a plurality of data channels indicative of the present environmental conditions;

map the data from the plurality of data channels into linear discriminant space using the plurality of transformation coefficients stored in the computer readable medium;

classify the present environmental conditions as belonging to one group of the plurality of groups based on the linear discriminant mapping of the data from the plurality of data channels; and signal an alarm condition if the present environmental conditions are classified as belonging to a group associated with a hazardous condition; and an alarm operatively connected to the processor, the alarm generating an audible alert, a visual alert, or a combination thereof in response to the alarm signal.

2. The smoke detector of claim 1, wherein the classification of the present environmental conditions as belonging to one group of the plurality of groups is based on the linear discriminant mapping of the plurality of data channels being outside a threshold in linear discriminant coordinates.

3. The smoke detector of claim 1, wherein processing the sensor data to generate derived signal data for the respective tests comprises applying different scaling factors to sensor data associated with different respective sensors.

4. The smoke detector of claim 1, wherein processing the sensor data to generate derived signal data for the respective tests comprises determining a difference between the sensor data and a moving average of the sensor data.

5. The smoke detector of claim 1, wherein assigning at least one group to the derived signal data for the respective tests comprises excluding extreme or inconclusive sensor data from any group.

6. The smoke detector of claim 1, wherein the inputted sensor data from the plurality of tests comprises data from individual tests broken down into time intervals for the test and wherein assigning at least one group to the derived signal data for the respective tests comprises assigning derived signal data for the time intervals to the groups.

7. A method of training a classifier for a smoke detector tuned for placement in a kitchen, comprising:

inputting sensor data from a plurality of tests into a processor, the sensor data indicative of environmental conditions during the tests;

using the processor to process the sensor data from the tests to generate derived signal data corresponding to the test data for respective tests, wherein processing the sensor data comprises tuning sensor data for detecting fires in the kitchen;

assigning the derived signal data into categories comprising at least one fire group and at least one non-fire group;

performing linear discriminant analysis (LDA) training using the processor and the derived signal data and the assigned categories for the derived signal data as input to the LDA training, the output of the LDA training generating a centroid in linear discriminant coordinates for each of the categories, a plurality of coefficients for transforming derived signal data into linear discriminant (LD) coordinates, and a mean of group means; and storing the plurality of coefficients, the plurality of centroids, and the mean of group means in a computer readable medium.

8. The method of claim 7, wherein the categories comprise plural fire groups, the fire groups including a flaming fire group and a non-flaming fire group.

9. The method of claim 8, wherein the at least one non-fire group comprises a normal group and a nuisance non-fire indicating group.

10. The method of claim 7, wherein tuning sensor data for detecting fires in the kitchen comprises removing any sensor data from grease-fire tests.

11. The method of claim 7, wherein using the processor to process the sensor data from the tests to generate the derived signal data comprises applying different scaling factors to sensor data associated with different respective sensors.

12. The method of claim 7, wherein using the processor to process the sensor data from the tests to generate the derived signal data comprises determining a difference between the sensor data and a moving average of the sensor data.

13. The method of claim 7, wherein the act of assigning the derived signal data into categories comprises excluding extreme and inconclusive sensor data from any category.

14. A non-transitory computer-readable medium storing computer-executable instructions thereon, the instructions for causing a processor to perform acts for training a classifier for a smoke detector, the acts comprising:

inputting sensor data from a plurality of tests into the processor, the sensor data indicative of environmental conditions during the tests;

using the processor to process the sensor data from the tests to generate derived signal data corresponding to the test data for respective tests;

assigning the derived signal data into categories comprising at least one fire group and at least one non-fire group;

performing linear discriminant analysis (LDA) training using the processor and the derived signal data and the assigned categories for the derived signal data as input to the LDA training, the output of the LDA training generating a centroid in linear discriminant coordinates for each of the categories, a plurality of coefficients for transforming derived signal data into linear discriminant (LD) coordinates, and a mean of group means; and storing the plurality of coefficients, the plurality of centroids, and the mean of group means.

15. The non-transitory computer-readable medium of claim 14, wherein the act of assigning the derived signal data into categories comprises excluding extreme and inconclusive sensor data from any category.

16. The non-transitory computer-readable medium of claim 14, wherein the inputted sensor data from the plurality of tests comprises data from individual tests broken down into time intervals for the test and the act of assigning comprises assigning derived signal data for the time intervals to the categories.

17. The non-transitory computer-readable medium of claim 14, wherein the sensor data includes data from an aerosol sensor and one or more sensors selected from the group consisting of a temperature sensor, a carbon monoxide sensor, a Taguchi sensor, and a carbon monoxide sensor.

18. The non-transitory computer-readable medium of claim 14, wherein the sensor data from each test is a time-series of sensor data over time periods and wherein the act of processing the sensor data comprises:

generating a first baseline based on a moving average over n previous measurements of the sensor data; and calculating a difference between a present measurement of the sensor data and the first baseline.

19. The non-transitory computer-readable medium of claim 14, wherein the act of assigning the derived signal data into categories comprises assigning the derived signal data for the respective time periods into the categories.

20. The non-transitory computer-readable medium of claim 14, wherein the act of storing comprises storing the plurality of coefficients, the plurality of centroids, and the mean of group means in a computer readable medium of the smoke detector.

* * * * *